US008444389B1

(12) United States Patent
Jones et al.

(10) Patent No.: US 8,444,389 B1
(45) Date of Patent: May 21, 2013

(54) MULTIPLE PIECE TURBINE ROTOR BLADE

(75) Inventors: Russell B Jones, Jupiter, FL (US); John A Fedock, Port St. Lucie, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 722 days.

(21) Appl. No.: 12/749,580

(22) Filed: Mar. 30, 2010

(51) Int. Cl.
*F01D 5/14* (2006.01)

(52) U.S. Cl.
USPC ..... 416/193 A; 416/226; 416/244 R; 416/248

(58) Field of Classification Search
USPC ..... 416/19 EA, 226, 248, 244 R
See application file for complete search history.

(56) References Cited

U.S. PATENT DOCUMENTS 4,790,721 A * 12/1988 Morris et al. ..... 416/96 A
7,758,314 B2 * 7/2010 Wilson et al. ..... 416/226
7,789,621 B2 * 9/2010 Dierksmeier et al. ..... 415/191
8,186,953 B1 * 5/2012 Kimmel ..... 416/97 R

* cited by examiner

*Primary Examiner* — Ninh H Nguyen
(74) *Attorney, Agent, or Firm* — John Ryznic

(57) ABSTRACT

A multiple piece turbine rotor blade with a shell having an airfoil shape and secured between a spar and a platform with the spar including a tip end piece. a snap ring fits around the spar and abuts against the spar tip end piece on a top side and abuts against a shell on the bottom side so that the centrifugal loads from the shell is passed through the snap ring and into the spar and not through a tip cap dovetail slot and projection structure.

12 Claims, 5 Drawing Sheets

MULTIPLE PIECE TURBINE ROTOR BLADE

GOVERNMENT LICENSE RIGHTS

This invention was made with Government support under contract number DE-FG02-07ER84668 awarded by Department of Energy. The Government has certain rights in the invention.

CROSS-REFERENCE TO RELATED APPLICATIONS

None.

BACKGROUND OF THE INVENTION

1. Field of the Invention

The present invention relates generally to gas turbine engine, and more specifically for a multiple piece turbine rotor blade.

2. Description of the Related Art Including Information Disclosed Under 37 CFR 1.97 and 1.98

A gas turbine engine, such as an industrial gas turbine (IGT) engine, a hot gas stream is passed through a turbine to produce mechanical energy. It is well known that the efficiency of the turbine, and therefore of the engine, can be increased by passing a higher temperature gas stream through the turbine. This is known as the turbine inlet temperature. The highest turbine inlet temperature is limited to the material properties of the turbine, especially the first stage stator vanes and rotor blades, since these airfoils are exposed to the highest temperature gas stream.

Higher turbine inlet temperatures can be can be obtained with a combination of improved material properties that will allow higher temperature and improved airfoil cooling. Prior art turbine rotor blades and made from nickel super alloys produced by the investment casting process. It has been proposed in the past to form the blades from high temperature resistant materials such as tungsten or molybdenum or columbium. These materials have melting temperature so high that they cannot be cast or machined using investment casting processes.

The applicant has proposed to form a turbine blade or stator vane from one of these exotic high temperature resistant materials in which the blade is formed with multiple pieces. one such embodiment is the spar and shell configuration in which a shell having an airfoil shape with a leading edge and a trailing edge, and a pressure side wall and a suction side wall, is formed from one of these exotic high temperature resistant materials using a wire EDM process for cutting the shell into its desired shape from a block of these materials. The shell is then secured to the spar and tip cap by clamping the shell between the tip cap and the platform of the blade. In order to use this spar and shell configuration, a separate tip cap from the spar is required. However, because the blade is a turbine rotor blade, the tip cap is exposed to high stress levels due to the centrifugal force developed from blade rotation.

with a separate tip cap secured to the top end of the spar, the applicant has discovered that very high stresses occur in the connection between the tip cap and the spar because all of the weight from the shell must be passed into the tip cap and then through the connections to the spar. This design—with a separate tip cap and the centrifugal loads from the shell being passed into the tip cap—produces very high stress levels in the tip cap to spar connection structure. A typical tip cap to spar connection that the applicant has used in a dovetail slot and groove connection.

BRIEF SUMMARY OF THE INVENTION

A multiple piece turbine rotor blade for use in a gas turbine engine, the rotor blade including a spar with tip end and a root and platform formed on the bottom end to form a single piece, a shell having an airfoil cross sectional shape with a leading and trailing edge and pressure and suction side walls extending between the two edges, the shell being secured between a platform of the spar and a top end of the spar, and where a snap ring is placed between the shell and the tip end of the spar to transfer all of the centrifugal loads from the spar onto the spar instead of a separate tip cap that is then secured onto the spar top end through a dovetail slot and groove structure.

The snap ring can be a two piece snap ring with shiplap abutments formed where the two pieces join. The snap ring abuts an underside surface of the tip end of the spar with the top end of the shell abutting onto a bottom side of the snap ring. A tip cap is secured on the top end of the spar to complete the multiple piece blade assembly. However, with the snap ring the centrifugal loads from the shell can be passed directly into the spar and not through the tip cap to spar dovetail slot and groove structure as in prior versions of the multiple piece rotor blade.

The shell is formed as a thin wall shell from an exotic high temperature resistant material that cannot be cast using conventional investment casting process, such as Molybdenum or Columbium.

DETAILED DESCRIPTION OF THE INVENTION

Figure 7:
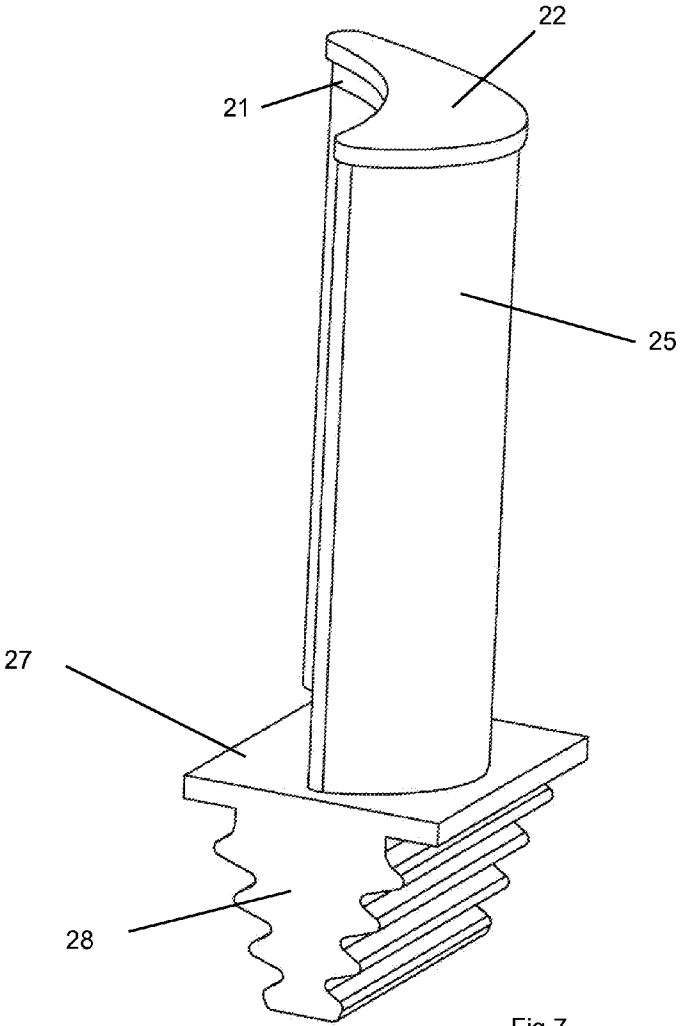
FIG. 7 shows a schematic view of an assembled turbine rotor blade of the present invention.

A turbine rotor blade of the spar and shell construction in which a shell is made from a different material than the rest of the blade assembly. The shell 25 is formed from an exotic high temperature resistant material, such as tungsten, molybdenum or columbium, because these materials are not castable. The spar 11 and the tip cap 22 can be formed from conventional materials such as nickel super alloys formed using the investment casting process with some machining after the casting process. In order to form a shell 25 from one of these materials, the wire EDM (electric discharge machining) process can be used to cut the shell from a single block of this material. The shell 25 is then secured between a tip end of the spar 11 and a platform 27 of the blade assembly. FIG. 7 shows an assembled spar and shell turbine rotor blade with a shell 25 secured in place between the tip cap 22 and a platform 27 and root piece 28. The spar 11 includes a root section 28 with a fir tree configuration and has the same shape as the fir tree section on two legs that extend from the platform piece 27 so that the assembled blade can be inserted into a slot of a rotor disk.

Figure 1:
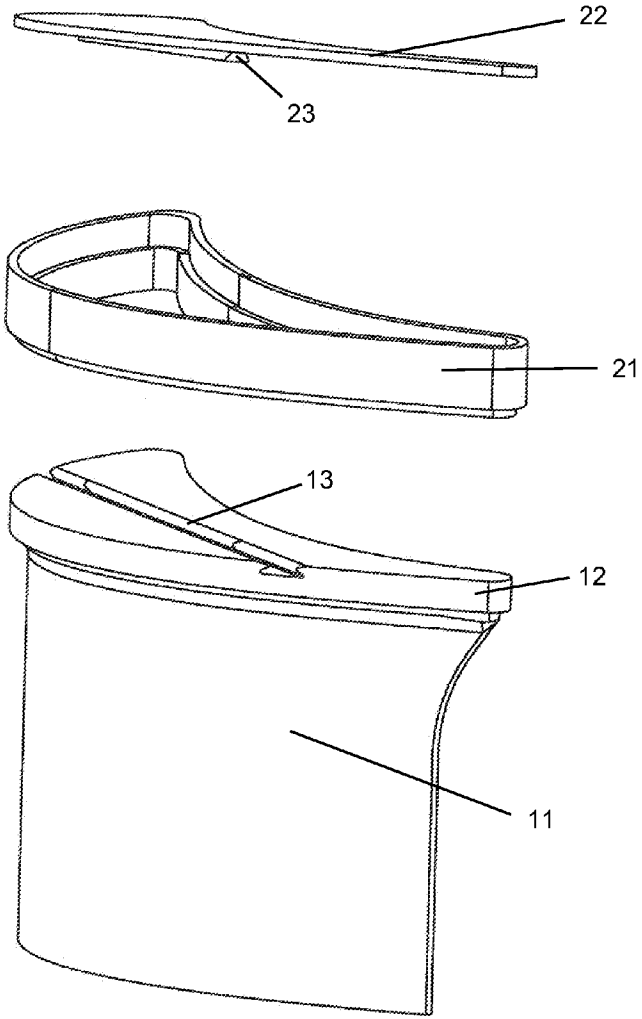
FIG. 1 shows an exploded view of a tip end of the multiple piece rotor blade with a snap ring positioned between a tip cap and the spar of the present invention.

FIG. 1 show an exploded view of the top end of the spar 11 with tip end piece 12 that includes a dovetail shaped slot 13 that opens on the top surface. A snap ring 21 is formed from one or more sections and fits on the bottom side of the spar tip end piece 12. a tip cap 22 includes a dovetail projection 23 extending from the bottom side and of similar shape and size of the dovetail slot in the spar tip end 12 so that the tip cap projection 23 will slide into the dovetail slot 13. FIG. 7 shows an assembled view of the rotor blade. One advantage of the snap ring 21 is that the blade assembly can be easily refurbished and re-assembled with a new shell 25 and tip cap 22.

Figure 2:
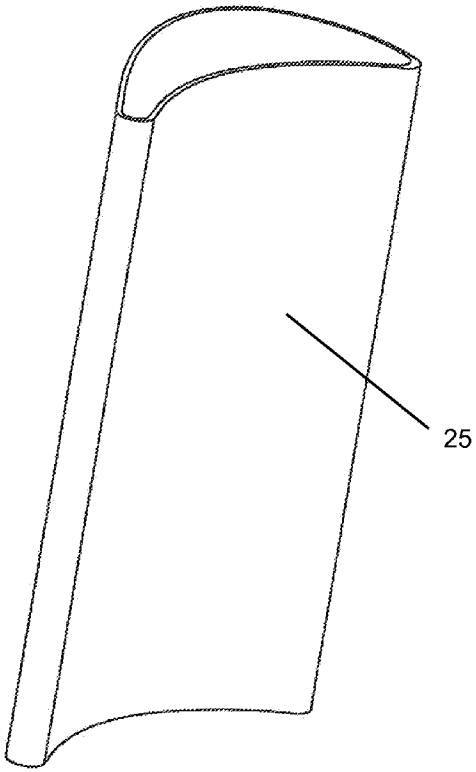
FIG. 2 shows an isometric view of a thin walled shell used in the turbine rotor blade assembly of the present invention.

FIG. 2 shows a schematic view of the shell 25 which forms the airfoil position of the blade and includes a leading edge and a trailing edge with a pressure side wall and a suction side wall extending between the two edges. The shell is a thin wall shell so that near wall cooling can be performed against the backside surface of the shell 25 by directing impingement cooling air from holes formed on the spar 11. The shell is made from an exotic high temperature resistant material that cannot be cast or machined like the prior art nickel super-alloy blades. These materials include Tungsten (for vanes), Molybdenum and Columbium (for blades or vanes). To form the thin wall shell, a wire EDM process is used to cut the shell from a block of one of these exotic high temperature materials. Tungsten can be used for a rotor blade, but is not desirable because of the high density.

Figure 5:
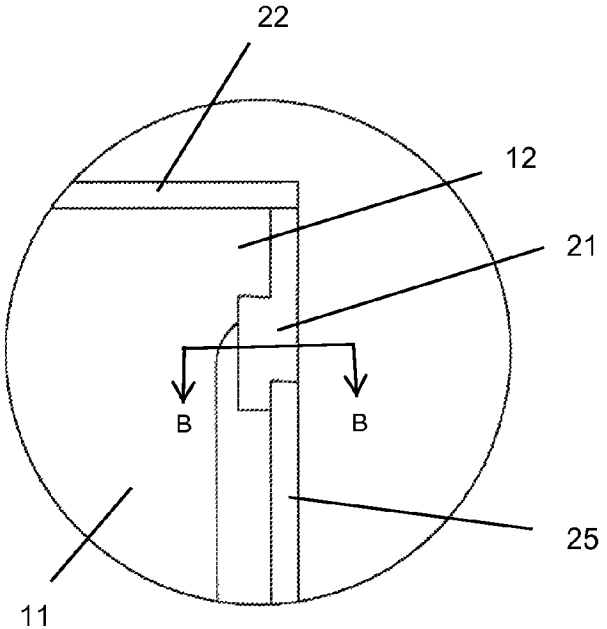
FIG. 5 shows a detailed close-up view of a corner of the blade in FIG. 4.
Figure 4:
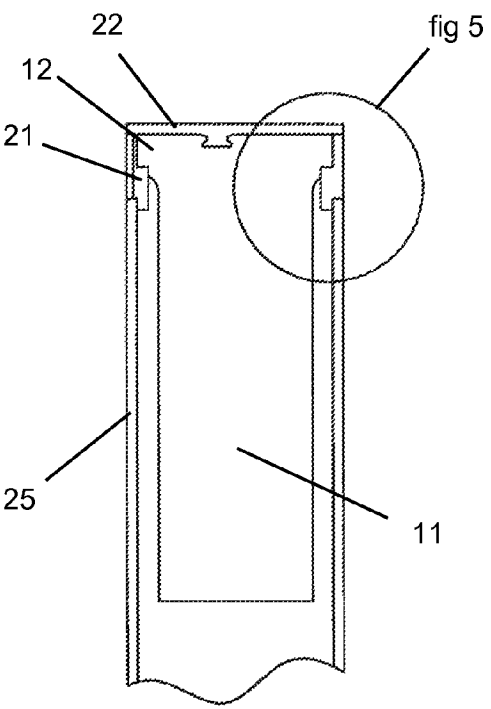
FIG. 4 shows a cross section view through the line A-A in FIG. 3 of the rotor blade of the present invention.
Figure 3:
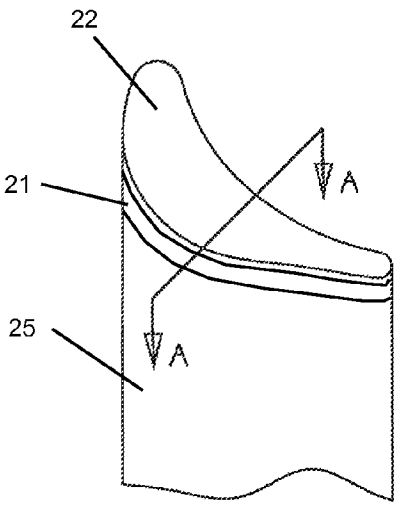
FIG. 3 shows a top end of the multiple piece turbine rotor blade of the present invention.

FIG. 3 shows a top end of the blade assembly with the tip cap surface flat on the top. FIG. 4 shows a cross section view through the line A-A in FIG. 3 with the spar 11 and the shell 25 in place over the spar. The shell 25 is placed over the spar 11 and then the snap ring 21 is placed between the top end of the shell 25 and the bottom abutment surface on the spar tip end piece 12. FIG. 5 shows a detailed view of this arrangement. The snap ring 21 has a stepped cross sectional shape so that the shell 25 will abut against a bottom surface of the snap ring so that the centrifugal load from the shell 25 will be transmitted to the tip end piece 12 of the spar 11. With this structure, the tip cap 22 can be inserted into the dovetail slot in the spar tip end piece 12 without any centrifugal loads from the shell passing through the dovetail slot and projection. The only centrifugal loads acting on the dovetail slot 13 and projection 23 would be from the weight of the tip cap 22.

Figure 6:
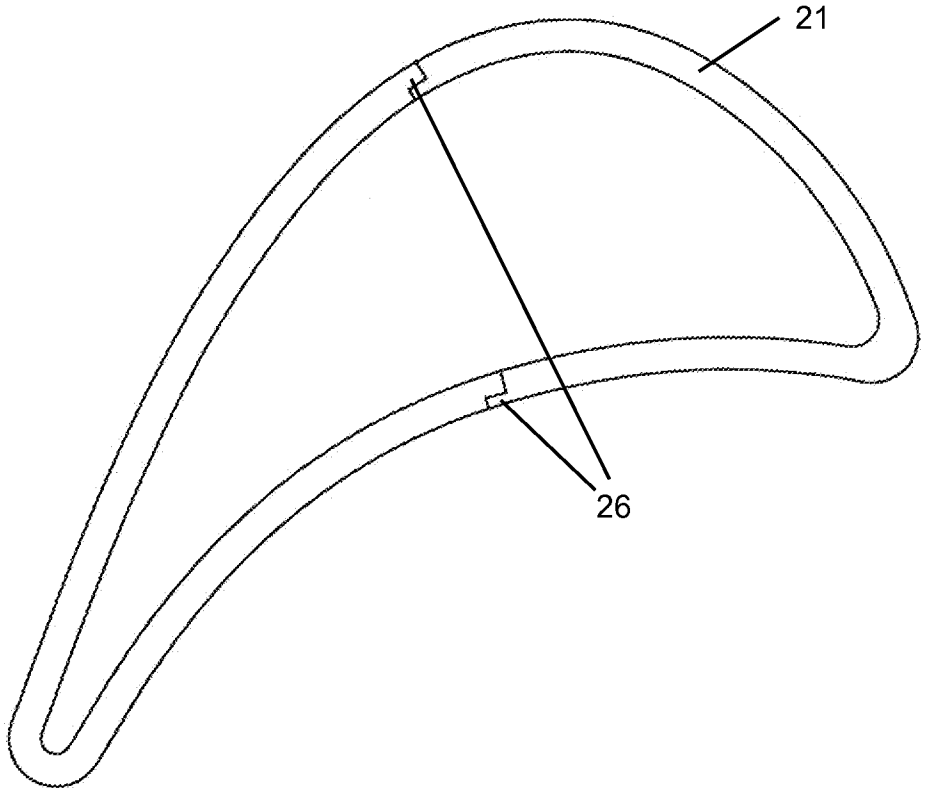
FIG. 6 shows a cross section view through line B-B of FIG. 5 of the snap ring used in the rotor blade of the present invention.

FIG. 6 shows the snap ring 21 made of two pieces with ship laps 26 formed on the ends that are joined together. The two ends 26 of the snap ring 21 are free-floating without any bond, or can be bonded together by a brazing process or other bonding process to join the two ends together and form one solid single piece snap ring 21. In another embodiment, the snap ring 21 can be made of one piece with an opening cut that forms one ship lap that can be expanded to fit the snap ring in place on the spar and then the ship lap abutment is secured together by a brazing process or other bonding process.

Figure 8:
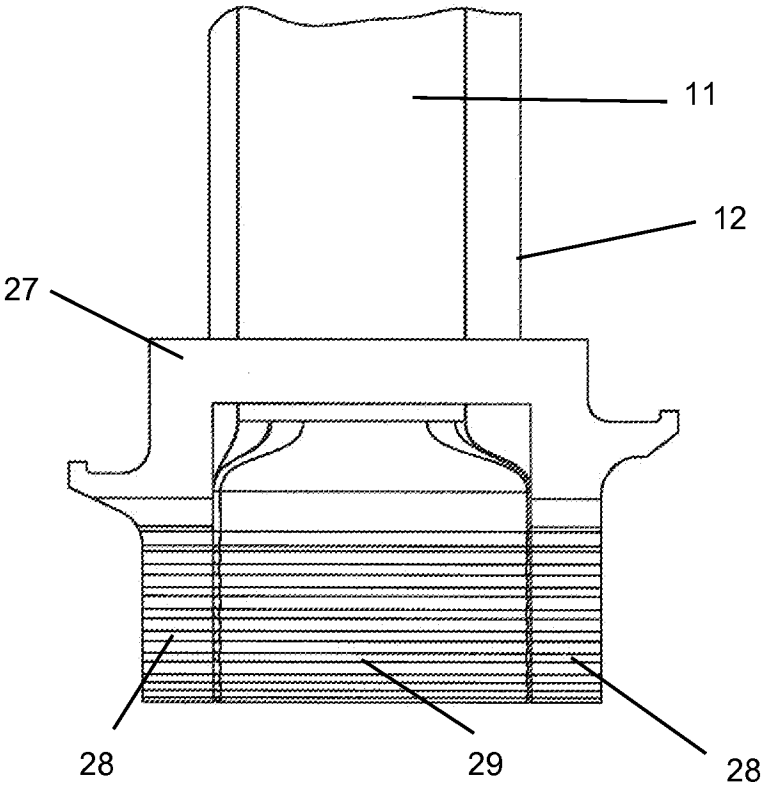
FIG. 8 shows a cross section view of the lower portion of the assembled rotor blade of the present invention.

FIG. 8 shows a cross section view of the bottom half of the blade assembly. The spar 11 includes a root section 29 with a fir tree configuration for insertion into a slot of a rotor disk. The platform section 27 is a separate piece from the spar 11 and includes an opening on the top surface of the platform 27 in which the spar 11 is inserted from the bottom. The platform section 27 includes two legs 28 that also have a fir tree configuration of the same shape and size as the root section 29. The platform 27 opening and the spar 11 is of such size that the spar 11 can be inserted up into the opening within the platform to assembly the multiple piece rotor blade. The spar 11 is inserted so that the spar 11 can project upward from the platform 27 beyond a final assembled position so that the shell 25 can be inserted over the spar 11 and the snap ring 21 inserted into place. With the shell 25 and snap ring 21 inserted into place over the spar 11, the spar 11 is then pulled back through the opening in the platform 27 to secure the shell 25 against the snap ring 21 and so that the fir trees of the spar root 29 and the two legs 28 of the platform 27 will be aligned for insertion into the slot formed within the rotor disk. All this is described in U.S. Provisional Patent Application No. 61/165,319 filed on Mar. 31, 2009 the entire disclosure of which is incorporated herein by reference.

We claim the following:

1. A multiple piece turbine rotor blade comprising:
a spar having a lower end with a fir tree configuration and a top end;
a platform piece with an opening to fit the spar from the bottom side;
the platform having two legs each with a fir tree configuration;
a shell having an airfoil shape;
a snap ring that wraps around the spar; and,
the snap ring has a lower abutment surface for a top end of a shell and a top abutment surface for the spar such that a centrifugal load of the shell is transmitted to the spar through the snap ring.

2. The multiple piece turbine rotor blade of claim 1, and further comprising:
the shell is a thin walled shell and is made from an exotic high temperature resistant material that cannot be cast or machined like a nickel super-alloy.

3. The multiple piece turbine rotor blade of claim 2, and further comprising:
the shell is made from Molybdenum or Columbium.

4. The multiple piece turbine rotor blade of claim 1, and further comprising:
the top end of the spar includes a slot; and,
a tip cap includes a projection on the bottom surface that slides within the slot to secure the tip cap to the spar.

5. The multiple piece turbine rotor blade of claim 4, and further comprising:
the slot in the spar extends from a forward section of the tip cap on a pressure wall side to an aft section of the tip cap on the pressure wall side.

6. The multiple piece turbine rotor blade of claim 4, and further comprising:
the slot in the spar is a single slot with a dovetail shape.

7. The multiple piece turbine rotor blade of claim 1, and further comprising:
the snap ring is formed from two pieces bonded together to form a single piece.

8. The multiple piece turbine rotor blade of claim 7, and further comprising:
the snap ring includes ship laps on the ends of the two pieces to bond the ends together.

9. A multiple piece turbine rotor blade comprising:
a spar having a lower end and a top end;
a platform piece with an opening to fit the spar from the bottom side;
a shell having an airfoil shape;
a snap ring that wraps around the spar; and,
the snap ring has a lower abutment surface for a top end of a shell and a top abutment surface for the spar such that a centrifugal load of the shell is transmitted to the spar through the snap ring.

10. The multiple piece turbine rotor blade of claim 9, and further comprising:

the snap ring is formed from two pieces having free-floating ends.

11. The multiple piece turbine rotor blade of claim 9, and further comprising:

the snap ring is formed from two pieces bonded together to form a single piece.

12. The multiple piece turbine rotor blade of claim 11, and further comprising:

the snap ring includes ship laps on the ends of the two pieces to bond the ends together.

* * * * *